US008842867B2

(12) United States Patent
Bothe

(10) Patent No.: US 8,842,867 B2
(45) Date of Patent: Sep. 23, 2014

(54) LOUDSPEAKER BOX WITH A VARIABLE RADIATION CHARACTERISTIC

(75) Inventor: Frank Bothe, Backnang (DE)

(73) Assignee: D & B Audiotechnik AG, Backnang (DE)

( * ) Notice: Subject to any disclaimer, the term of this patent is extended or adjusted under 35 U.S.C. 154(b) by 1389 days.

(21) Appl. No.: 12/379,368

(22) Filed: Feb. 19, 2009

(65) Prior Publication Data

US 2009/0214067 A1 Aug. 27, 2009

(30) Foreign Application Priority Data

Feb. 22, 2008 (DE) ..... 10 2008 010 524

(51) Int. Cl.

| | |
|---|---|
| ***H04R 1/20*** | (2006.01) |
| ***H04R 1/02*** | (2006.01) |
| ***H04R 1/34*** | (2006.01) |
| *H04R 27/00* | (2006.01) |
| *H04R 1/40* | (2006.01) |
| *H04R 1/26* | (2006.01) |

(52) U.S. Cl.

CPC ..... *H04R 1/345* (2013.01); *H04R 1/026* (2013.01); *H04R 27/00* (2013.01); *H04R 1/403* (2013.01); *H04R 2201/401* (2013.01); *H04R 1/26* (2013.01)

USPC ..... 381/345; 381/339; 381/337; 381/387

(58) Field of Classification Search

USPC ..... 381/339, 345, 337, 387

See application file for complete search history.

(56) References Cited

U.S. PATENT DOCUMENTS

| | | | | |
|---|---|---|---|---|
| 3,642,091 | A * | 2/1972 | Nohara et al. | 181/150 |
| 7,316,290 | B2 * | 1/2008 | Hutt et al. | 181/176 |
| 2003/0188920 | A1 * | 10/2003 | Brawley, Jr. | 181/176 |

FOREIGN PATENT DOCUMENTS

| | | | |
|---|---|---|---|
| DE | 21267 | | 3/1956 |
| DE | 297 17 524 | U1 | 2/1998 |
| DE | 102 30 409 | C1 | 7/2002 |
| DE | 102 30 409 | C1 | 10/2003 |
| DE | 10 2005 022 869 | A1 | 11/2006 |
| EP | 1 635 606 | A1 | 3/2006 |
| GB | 2 425 436 | A | 10/2006 |
| JP | 2004-64507 | | 2/2004 |

OTHER PUBLICATIONS

Englsih translation DE 10230409.*
Model 2395, JBL Catalogue, website action audio, pp. 14.
http://wwwalconsaudio.com/site/index.html, p. 1.
British Search Report dated May 14, 2009 and issued in corresponding British Patent Application GB0901153.7.

* cited by examiner

*Primary Examiner* — Elvin G Enad
*Assistant Examiner* — Ronald Hinson

(57) ABSTRACT

A loudspeaker box (300) has a loudspeaker housing (1) and a sound source (3*a*) with a non-rotationally symmetrical radiation characteristic. The sound path of the sound source (3*a*) contains an acoustic element (4) which dilates or constricts the radiation of sound in at least one radiation plane. The loudspeaker box (300) comprises a mechanism which can be used to position the sound source (3*a*) and the acoustic element (4) in different rotational positions relative to one another.

28 Claims, 4 Drawing Sheets

LOUDSPEAKER BOX WITH A VARIABLE RADIATION CHARACTERISTIC

CROSS-REFERENCE TO RELATED APPLICATIONS

This application claims the benefit of German Application No. 10-2008 010 524.4, filed with the German Intellectual Property Office on Feb. 22, 2008, the disclosure of which is incorporated herein by reference.

FIELD

The invention relates to a loudspeaker box and to arrangements comprising a plurality of loudspeaker boxes.

BACKGROUND

Loudspeaker systems typically have different radiation properties in the horizontal and vertical planes. This is generally used in a targeted fashion to provide even sound for audience areas of various geometry. A customary measure for obtaining a defined radiation behaviour for a sound source is to use particular loudspeaker types or a horn for the sound routing.

Loudspeaker boxes can be operated as individual systems or in loudspeaker groups. Typical individual systems are loudspeaker boxes which have been set up in the domestic sector, for example. Loudspeaker groups are frequently used when sound needs to be provided for larger areas or spaces. By way of example, loudspeaker groups are used for concerts, e.g. for open-air concerts or in halls. In the case of loudspeaker groups, it is necessary to take account not only of the acoustic properties of the individual loudspeaker boxes but also of the arrangement of the loudspeaker boxes relative to one another, which significantly influences the overall radiation behaviour of the loudspeaker group. One frequently used loudspeaker group is what are known as line arrays, for example, in which loudspeaker boxes are arranged beneath one another in a vertical column.

SUMMARY

The invention is based on the object of providing loudspeaker boxes which can be used in versatile fashion.

The object on which the invention is based is achieved by the features of the independent claims. Advantageous embodiments and developments of the invention are specified in the dependent claims.

According to claim 1, the loudspeaker box has a loudspeaker housing and a sound source with a non-rotationally symmetrical radiation characteristic. The sound path of the sound source contains an acoustic element which dilates or constricts the radiation of sound in at least one radiation plane. In addition, the loudspeaker box comprises a mechanism which can be used to position the sound source and the acoustic element in different rotational positions relative to one another.

The acoustic element brings about a change in the acoustic wavefront, and repositioning the sound source relative to the acoustic element changes the radiation angle of the wavefront emitted by the loudspeaker box in at least one plane in reference to the sound source. The effect which can be achieved by this is that the loudspeaker box is suitable both for operation in a horizontal position and for operation in a vertical position. This allows the loudspeaker box to be configured for different applications or fields of use. By way of example, it can be used as an individual loudspeaker box or in an array arrangement comprising a plurality of loudspeaker boxes (e.g. line array comprising a column of horizontally oriented loudspeaker boxes).

In line with one expedient refinement, the acoustic element dilates the sound field. In this case, the radiation of sound is dilated in the at least one radiation plane. However, it is also possible for the acoustic element to constrict the sound field in at least one radiation plane. In many cases, functionally comparable solutions in reference to the radiation characteristic can be provided by acoustic elements which constrict the sound field or dilate the sound field.

The acoustic element can be implemented in a wide variety of ways. One option is for the acoustic element to comprise one or more perforated panels. The perforated panels alter the phase response or the propagation-time response of the acoustic wave when passing through the holes such that the wavefront curves outwards, i.e. is dilated.

In line with another implementation option, the acoustic element may comprise a set of parallel lamellae. Inclination of the lamellae with respect to the acoustic axis means that they act as detour elements which delay the sound and thereby alter the wavefront. The length of the lamellae in the path of the sound allows the propagation delay and hence the deformation of the wavefront to be set in a targeted fashion. Instead of a set of lamellae, it is also possible to integrate other detour elements with comparable effect into the sound path.

Another way for the wavefront to be influenced by the acoustic element is to provide an acoustic element comprising a porous material.

Said and other acoustic elements can be operated in transmission and are therefore also frequently referred to as "acoustic lenses". However, it is also possible for the acoustic element to be designed in the form of a reflective body. A reflective body of this kind may be arranged as a repositionable or rotatable core within or partially within a horn, for example, and can influence the radiation characteristic of the horn and alter it when repositioned relative to the horn.

Many and diverse combinations of the aforementioned forms of an acoustic element are possible. All of said implementations of an acoustic element operated in transmission can be combined. In addition, the acoustic element may also be a combination of transmissive bodies and reflective bodies.

The mechanism for repositioning the acoustic element relative to the sound source may be in a form such that the sound source can be repositioned (e.g. rotated) in reference to the loudspeaker housing. In this case, the acoustic element may be fitted on the loudspeaker housing at a fixed location, for example.

Another option is to design the mechanism such that the acoustic element can be repositioned in reference to the loudspeaker housing. In this case, a sound source which cannot be rotated relative to the loudspeaker-housing may be used, for example.

The sound source may have a linear or quasi-linear profile and be implemented by the diffraction gap of a horn (what is known as a diffraction horn), for example. Such a horn typically has a smaller radiation angle in the plane defined by the profile of the diffraction gap than in the plane which is at right angles thereto. However, it is also possible to implement a sound source having a linear profile in another way, e.g. by using a quasi-linear sound generator such as a ribbon loudspeaker, an air motion transformer (AMT) or a linear arrangement of a large number of small sources (e.g. a row of small dome tweeters).

The mechanism may have a rotary mechanism supporting the sound source. In this case, it is possible for the location repositioning between the sound source and the acoustic element to be brought about by twisting the sound source articulated to the rotary mechanism. In general, however, it is also possible for other repositioning mechanisms, e.g. unpluggable mounts or the like, to be provided, and it is also possible for the repositioning to be achieved not by means of a mechanism which engages with the sound source but rather by means of a mechanism which engages with the acoustic element.

Another aspect of the invention relates to a loudspeaker box with a loudspeaker housing and a sound source which can be positioned in different rotational positions relative to the loudspeaker housing a mechanism. In addition; the loudspeaker box comprises a positioning mechanism for positioning at least one acoustic element, which dilates or constricts the radiation of sound in at least one radiation plane, into the sound path of the sound source.

As already explained, repositioning of the sound source allows the radiation behaviour of the loudspeaker box to be customized to the respective application (loudspeaker group or individual solution) or the respective position of the loudspeaker box (on its side or upright). However, the acoustic element is required only in one of these two positions and can be placed in front of the sound source in this one position by means of the positioning mechanism (e.g. hinged, swivel or sliding mechanism) or can be retrospectively fitted on the loudspeaker box in this one position using a coupling.

The invention is explained below using exemplary embodiments with reference to the drawings, in which:

DETAILED DESCRIPTION

Figure 1:
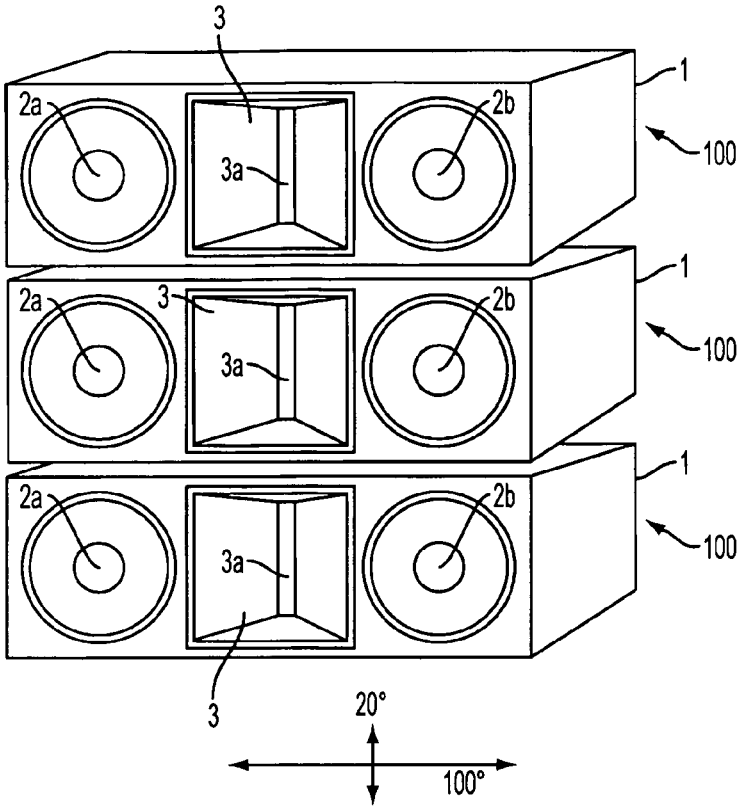
FIG. 1 shows a perspective illustration of a group of horizontally oriented loudspeaker boxes.

FIG. 1 shows an arrangement comprising three horizontally oriented loudspeaker boxes 100 situated above one another. Such an arrangement of loudspeaker boxes 100 occurs in what are known as line arrays, for example, in which the loudspeaker boxes 100 are arranged as seamlessly as possible in a vertical column. To expand the radiation behaviour of the line array in a defined manner and to provide even sound for the listening area, the loudspeaker housings 1 of the loudspeaker boxes 100 have a slightly conical shape so that adjacent loudspeaker boxes 100 can be oriented at a slight angle with respect to one another in the line array, which is then somewhat curved.

The text below discusses the lengthwise dimension, the crosswise dimension and the depth of a loudspeaker housing 1 of a loudspeaker box 100, the lengthwise dimension being defined as the larger of the two dimensions appearing in a front view. In FIG. 1, the lengthwise dimension of the loudspeaker box 100 is thus oriented horizontally and the crosswise dimension of the loudspeaker box 100 is oriented vertically. The longitudinal direction of the loudspeaker box 100 may contain a plurality of drivers situated next to one another, e.g. two outer drivers 2*a*, 2*b* and one central driver (not visible) which opens into a horn 3. The central driver may be a tweeter driver, for example. The lengthwise dimension may be more than twice or three times as large as the crosswise dimension, for example.

In the loudspeaker boxes 100 shown in FIG. 1, the horn 3 has a diffraction gap 3*a* which is oriented in a vertical direction. The effect achieved by this is that the vertical radiation angle of the tweeter soundwave is relatively small, while the horizontal radiation angle of the horn 3 can be made much larger. For use in a line array, provision may be made, by way of example, for the horizontal radiation angle prescribed by the shape of the horn 3 to comprise approximately 100°, whereas the vertical radiation angle (likewise prescribed by the shape of the horn 3) of an individual loudspeaker box 100 comprises only approximately 20°. In a line array application, this vertical radiation angle of an individual loudspeaker box 100 should not exceed approximately 25°.

Figure 2:
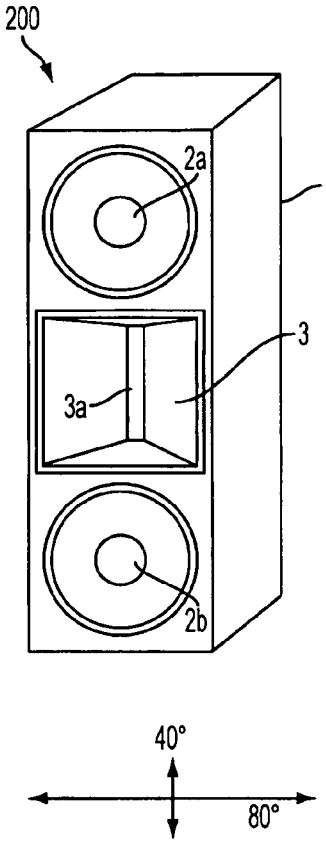
FIG. 2 shows a perspective illustration of a vertically oriented loudspeaker box which is suitable for standalone operation.

FIG. 2 shows a loudspeaker box 200 which is suitable for standalone operation. In the example shown here, it is oriented upright. The same or similar parts are provided with the same reference symbols in the figures. Individually operated loudspeaker boxes 200 are typically oriented in an upright position. This has partly visual and acoustic reasons, since in a system with a plurality of drivers 2*a*, 2*b* a vertical arrangement generally meets the radiation requirements (wide horizontally, narrow vertically) better. In this respect, the loudspeaker box 200 shown in FIG. 2 differs from the loudspeaker box 100 shown in FIG. 1 in that the diffraction gap 3*a* of the horn 3 runs in a lengthwise dimension of the loudspeaker box 200. Furthermore, with a loudspeaker box 200 used as a standalone solution, the radiation requirements which apply are different from those for the loudspeaker boxes 100 in a line array which are shown in FIG. 1. In reference to the tweeter soundwave, it may be beneficial if a radiation angle of approximately 80° can be achieved in the horizontal direction. In the vertical direction, the radiation angle of the tweeter soundwave is supposed to be larger than the maximum permissible radiation angle for line array applications, and is supposed to be approximately 40°, for example. The horn 3 of the loudspeaker box 200 for operation as an individual system therefore needs to be shaped differently from the horn 3 of the loudspeaker boxes 100 designed for operation in a loudspeaker group.

The invention is based on the idea that a loudspeaker box (see FIG. 1) provided for a loudspeaker group (e.g. line array) has its function changed to form a loudspeaker box (see FIG. 2) which is suitable for standalone operation by repositioning a sound source with a non-rotationally symmetrical radiation characteristic. Since repositioning of the sound source particularly in the vertical direction does not yet provide a usable radiation behaviour (radiation behaviour is too narrow in the vertical direction), an acoustic element is also used which corrects the radiation behaviour in a suitable fashion for the loudspeaker box rotated through 90°. As discussed in more detail below, it is likewise possible for the acoustic element instead of the sound source to be repositioned relative to the loudspeaker box, and for the acoustic element to be only in one of the positions of the loudspeaker box in the sound path.

In the exemplary embodiments which follow, the invention is explained by way of example with reference to a sound source which is implemented by a diffraction gap 3*a* (e.g. a horn 3). However, the loudspeaker boxes according to the invention may also use other types of sound sources with a non-rotationally symmetrical radiation characteristic. By way of example, instead of a diffraction gap 3*a*, a ribbon tweeter may be provided whose sound-emitting opening is likewise shaped linearly. A further option is to use what is known as an air motion transformer (AMT) as a sound source. AMTs are sound transducers which produce sound by having a concertinaed diaphragm with conductor tracks arranged meandrously on it. AMTs are preferably used as tweeters in the frequency range from approximately 1 kHz to approximately 25 kHz. By virtue of their design, they likewise have an elongate or linear sound exit opening. A further option for providing a sound source having quasi-linear shaping is to provide a linear arrangement of small loudspeakers (e.g. dome tweeters). All of said sound sources with linear shaping can optionally be combined with a horn 3, the shaping of the horn 3 allowing additional shaping of the sound field emitted by the sound source 3*a*. It should be pointed out that in all of the exemplary embodiments which follow, the diffraction gap 3*a* serving as a sound source is to be understood merely by way of example and can be replaced by the aforementioned and other sound sources with a non-rotationally symmetrical (for example linear) radiation characteristic, possibly in combination with a horn 3.

It should also be pointed out that the terms loudspeaker box "on its side" and "upright" loudspeaker box used here are intended, in their general meaning, to denote only situations of a loudspeaker box which are rotated through 90°. Although loudspeaker boxes in a line array are typically oriented such that their lengthwise dimension runs in the horizontal direction and their crosswise dimension runs in the vertical direction, and this is usually exactly the other way round for loudspeaker boxes which are suitable for standalone operation, it is also possible to construct line arrays from loudspeaker boxes with a lengthwise dimension in the vertical direction and to design boxes which are suitable for standalone operation to have a lengthwise dimension in the horizontal direction. The demands to be met on the radiation characteristics remain unaffected thereby, however, i.e. in this case too a loudspeaker box in the line array should have a radiation angle of no greater than approximately 25° in the vertical, for example.

Figure 3:
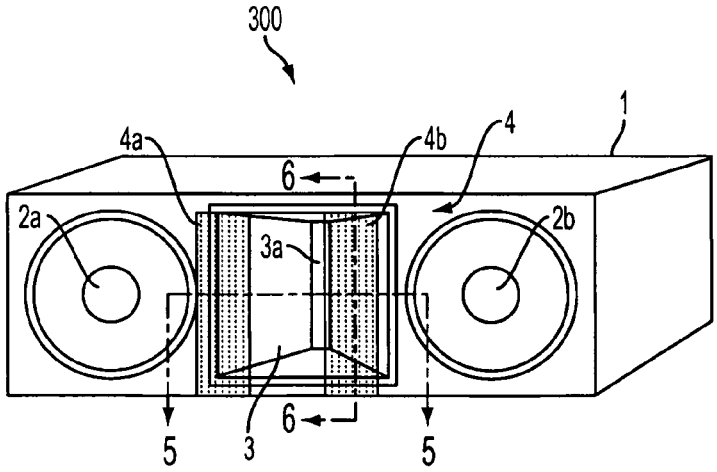
FIG. 3 shows a perspective illustration of a horizontally oriented loudspeaker box with an acoustic element, which is suitable for operation in a loudspeaker group.

FIG. 3 shows an exemplary embodiment of a loudspeaker box 300 which is suitable both for operation in a loudspeaker group and for operation as an individual box. The loudspeaker housing 1 and the drivers 2*a*, 2*b* correspond to the parts explained in FIGS. 1 and 2 with the same reference symbols. The loudspeaker box 300 differs from the loudspeaker box 100 shown in FIG. 1 in that the sound path contains an acoustic element 4 arranged before the horn 3. By way of example, the acoustic element 4 may be in the form of an acoustic lens 4. The acoustic lens 4 comprises two lens elements 4*a*, 4*b* and causes the radiation angle of the tweeter soundwave to be dilated in the horizontal direction. By way of example, the horn 3 may be designed such that the radiation angle of the horn 3 is approximately 80° in the horizontal direction (i.e. crosswise with respect to the diffraction gap 3*a* of the horn 3) and is approximately 20° in the direction of the diffraction gap 3*a*. The acoustic lens 4 causes this radiation angle to be dilated, e.g. to approximately 100°. The radiation properties desired for groups of loudspeaker boxes 100 are thus achieved, see FIG. 1.

Figure 4:
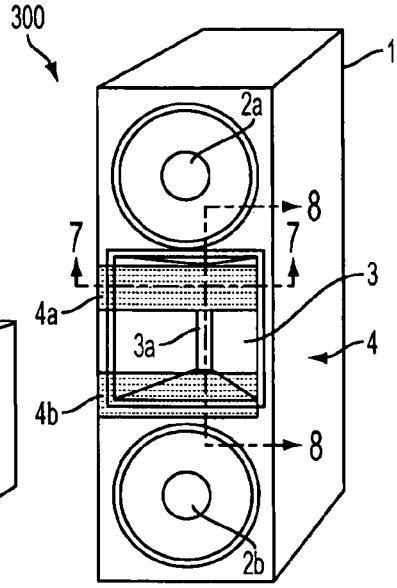
FIG. 4 shows a perspective illustration of the vertically oriented loudspeaker box from FIG. 3 with an acoustic element, which is reconfigured for standalone operation.

FIG. 4 shows the loudspeaker box 300 shown in FIG. 3 in a vertical arrangement, i.e. oriented upright with the lengthwise dimension in the vertical direction. The horn 3 with the diffraction gap 3*a* has been repositioned through 90° with respect to the position shown in FIG. 3. The repositioning can be achieved by rotating the horn 3, for example, which to this end may be attached to a pivot bearing (not visible). The pivot bearing may be attached to the tweeter loudspeaker (not shown) or to the loudspeaker housing 1, for example. If only the diffraction gap 3*a* or another linear sound source without a horn 3 is used, the diffraction gap 3*a* or the other linear sound source is arranged so as to be appropriately repositionable or rotatable.

When the horn 3 has been repositioned, it has a radiation angle of approximately 80° in the horizontal direction and of approximately 20° in the vertical direction, using the radiation variables indicated by way of example in FIG. 3. In this case, the acoustic lens 4, which in this case is fitted on the loudspeaker housing 1 at a fixed location, for example, influences only the radiation angle in the vertical direction and dilates it from 20° (see FIG. 3) to 40°. Hence, a radiation behaviour is achieved which meets the requirements for a loudspeaker box which is suitable for standalone operation (see FIG. 2).

The radiation angle of the horn 3, which is prescribed by the shaping of the horn 3, in the direction of the diffraction gap 3*a* and in the crosswise direction relative to the diffraction gap 3*a* and also the change in the radiation angle by the acoustic lens 4 may vary in a wide range according to the field of use and design of the loudspeaker box 300. This is also possible because the radiation angles of the horn 3 and the influencing of these radiation angles by the acoustic element 4 can be attuned to one another. By way of example, the use of an acoustic lens 4 which severely dilates the radiation of sound of the horn 3 allows the use of a horn 3 which has a much smaller radiation angle than 20° in the direction of the diffraction gap 3*a*. In addition, as will be explained in more detail below, it is also possible to use acoustic lenses 4 which constrict the radiation of sound instead of dilating it, which means that the opposite circumstances then prevail and, by way of example, it is possible to use a horn 3 whose radiation angle may be much greater than 20° in the direction defined by the diffraction gap 3*a*.

If the acoustic lens 4 dilates the radiation of sound, the horn 3 may, in line with one exemplary embodiment, have a radiation characteristic of no more than 25° in the plane defined by the diffraction gap 3*a*. In the position of the loudspeaker box 300 which is shown in FIG. 4, the acoustic lens 4 can then dilate the radiation characteristic in the plane defined by the diffraction gap 3*a* to least 30°. In the plane oriented at right angles to the diffraction gap 3*a*, the horn may have a radiation characteristic of at least 60°. In the position of the loudspeaker box 300 which is shown in FIG. 3, the acoustic lens 4 can then dilate the radiation characteristic in the plane oriented at right angles to the diffraction gap 3*a* to at least 80°, for example.

Figure 5:
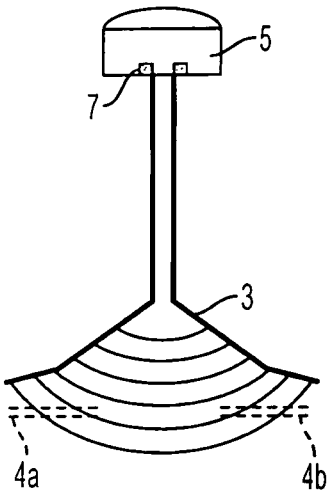
FIG. 5 shows a horizontal sectional illustration along the sectional line 5-5 in FIG. 3.
Figure 6:
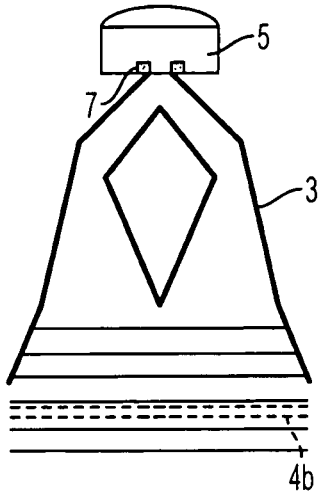
FIG. 6 shows a vertical sectional illustration along the sectional line 6-6 in FIG. 3.

FIGS. 5 and 6 show sectional illustrations along the lines 5-5 and 6-6, Respectively, in FIG. 3. On the input side of the horn 3, the aforementioned tweeter driver 5 is arranged. The tweeter driver 5 and the horn 3 have the aforementioned pivot bearing 7 provided between them, for example. As can be seen from FIGS. 5 and 6, the acoustic lens 4 is situated in the sound path downstream of the exit plane of the horn 3. In the horizontal plane (FIG. 5), the lens elements 4*a*, 4*b*, influencing the soundwave only in sectors to the side of the main propagation direction (i.e. the central axis of the horn 3) achieve dilation of the sound field, while in the vertical direction (FIG. 6) a lens element (in this case 4*b*) influences the soundwave evenly over its entire radiation range and hence does not bring about any change in the radiation angle in the vertical direction.

Figure 7:
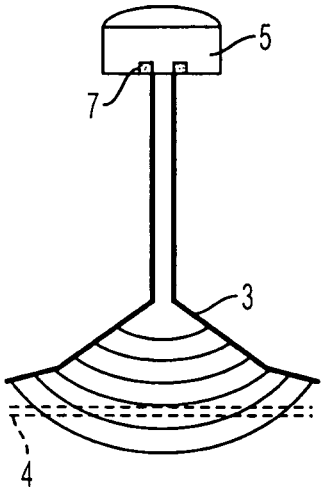
FIG. 7 shows a horizontal sectional illustration along the sectional line 7-7 in FIG. 4.
Figure 8:
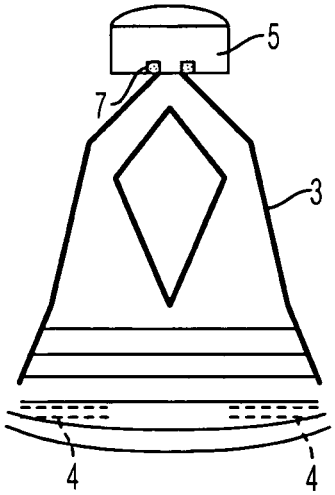
FIG. 8 shows a vertical sectional illustration along the sectional line 8-8 in FIG. 4.

FIGS. 7 and 8 show sectional illustrations along the lines 7-7 and 8-8 respectively, in FIG. 4. On account of repositioning of the horn 3 with the diffraction gap 3*a* relative to the acoustic lens 4, opposite circumstances to those in FIGS. 5 and 6 prevail in this case. The radiation behaviour is not influenced by the acoustic lens 4 in the horizontal direction (FIG. 7), while in the vertical direction (FIG. 8) the sound field emitted by the horn 3 is dilated.

FIGS. 7 and 8 show sectional illustrations along the lines 7-7 and 8-8 respectively, in FIG. 4. On account of repositioning of the horn 3 with the diffraction gap 3*a* relative to the acoustic lens 4, opposite circumstances to those in FIGS. 5 and 6 prevail in this case. The radiation behaviour is not influenced by the acoustic lens 4 in the horizontal direction (FIG. 7), while in the vertical direction (FIG. 8) the sound field emitted by the horn 3 is dilated.

Figure 9:
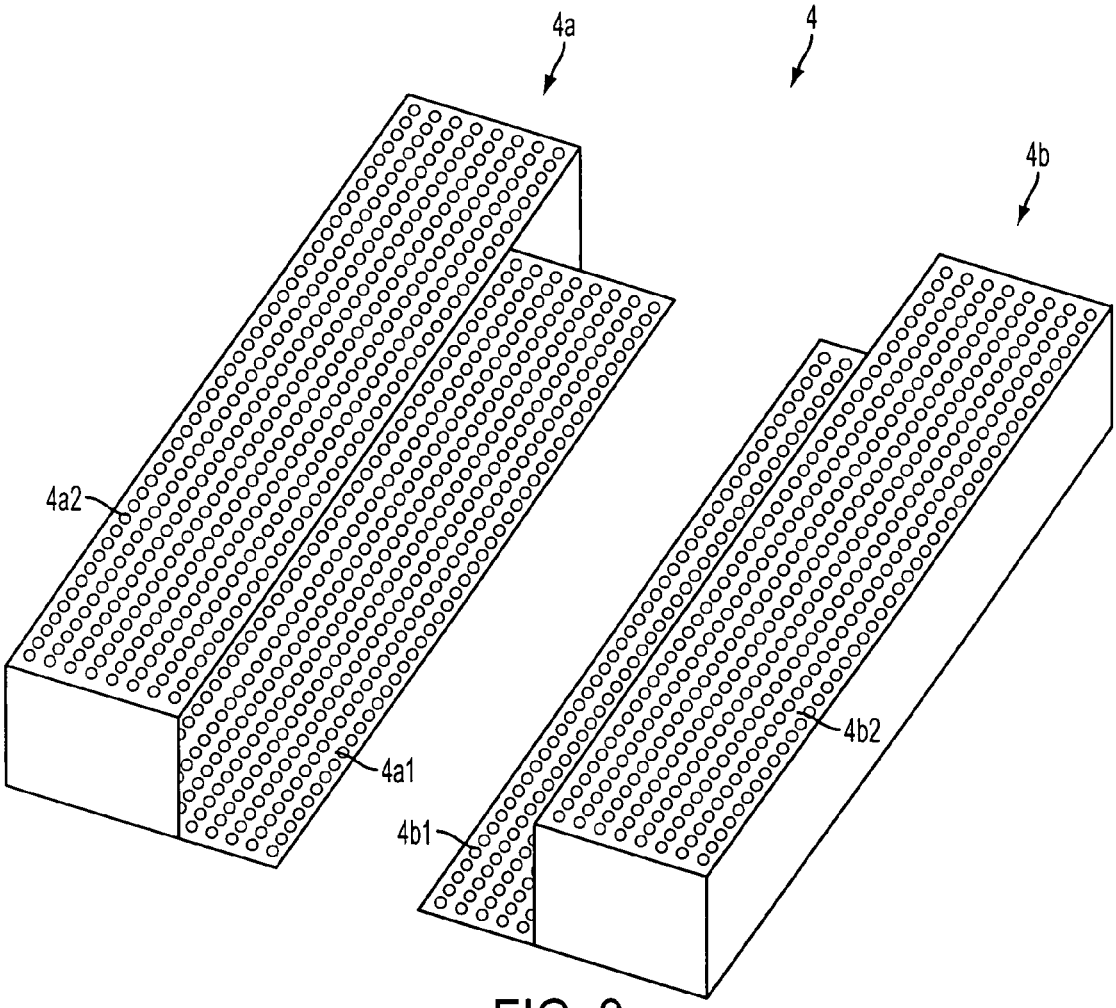
FIG. 9 shows a perspective view of an acoustic lens with a plurality of perforated panels.

The acoustic lens 4 can be implemented in a wide variety of ways. A first implementation option, which has been used by way of example in FIGS. 3 to 8, involves the acoustic lens 4 being implemented in the form of perforated panels or perforated sheets. The perforated panels influence the transmission of the sound. The holes produce a low-pass filter behaviour which can be set by the hole size and grid spacing. The low-pass filter causes a change of phase response and hence a propagation-time behaviour which curves the wavefront. As FIG. 9 shows, there may also be a plurality of perforated panels 4*a*1, 4*a*2 and 4*b*1, 4*b*2 arranged above one another, which means that the sound-field-dilating effect of the acoustic lens 4 is amplified in the outer region, for example, i.e. for large radiation angles relative to the central axis of the horn 3.

Figure 10:
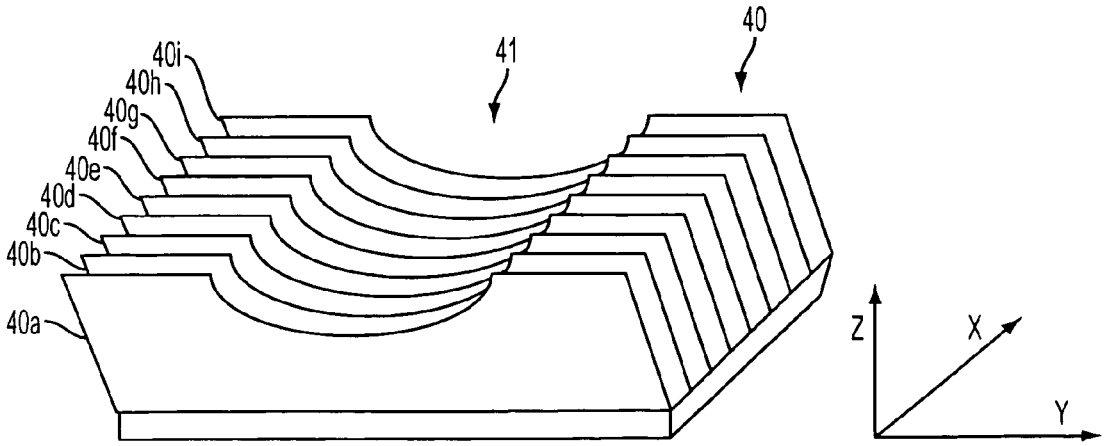
FIG. 10 shows a perspective view of an acoustic lens with a set of parallel lamellae.

Another implementation option for the acoustic lens 4 involves introducing detour elements into the sound field. Detour elements in the sound field lengthen the path and therefore increase the propagation time and therefore likewise result in curvature of the wavefront. An acoustic lens 40 based on the principle of detour elements is shown by way of example in FIG. 10. The detour elements used here are parallel lamellae 40*a*, 40*b*, 40*c*, 40*d*, 40*e*, 40*f*, 40*g*, 40*h*, 40*i* which are arranged so as to be inclined with respect to the central axis z of the horn 3 (the x-y plane is the opening plane of the horn 3). The longer the detour elements 40*a*, . . . , 40*i*, the more pronounced the propagation-time effect and hence the effect of the acoustic lens 40. If the lamellae 40*a*, . . . , 40*i* are cut out in a central region 41, i.e. have a shorter length at that point than in the case of larger radiation angles, the sound must take a longer detour for larger radiation angles than for small radiation angles. This results in the sound field being dilated.

Another option for implementing an acoustic lens 4 is to arrange a material in front of the horn 3 which alters the speed of sound locally. A reduction in the speed of sound, e.g. in the regions shown by the lens elements 4*a*, 4*b* in FIGS. 5 to 8, likewise results in the sound field being dilated.

It is also possible to use acoustic lenses 4 which constrict the radiation of sound in at least one radiation plane. Such "focusing" acoustic lenses 4 may be based on the same principles (detour elements, elements with a low-pass filter behaviour, medium with different speed of sound). By way of example, one or more perforated panels in a central region of the horn 3, a detour element in a central region of the horn 3 or an element with a reduced speed of sound in the central region of the horn 3 (or elements which increase the speed of sound in outer regions of the horn 3) bring about constriction of the radiation of sound.

Another variant involves the acoustic element being designed not as an acoustic lens operated in transmission but rather as a reflective body which is implemented at least in part in the sound path before (i.e. upstream of) the opening plane of the horn 3. In this case, the acoustic element influences the radiation characteristic of the horn. By repositioning the acoustic element relative to the horn 3, it is possible to achieve targeted alteration of the radiation behaviour of the horn 3 in reference to the plane defined by the diffraction gap 3*a* or to said plane's normal plane.

The acoustic element 4 (lens or reflective body or both) can be repositioned relative to the horn 3 with a non-symmetrical radiation behaviour in a wide variety of ways. By way of example, as already mentioned, the horn 3 may be fitted rotatably on the tweeter driver 5 or on the loudspeaker housing 1. By way of example, as indicated in FIGS. 5 to 8, the horn 3 has a round flange 7 by means of which it is mounted on the tweeter driver 5 and can be rotated through 90°. The horn 3 can be rotated using, by way of example, a small opening (not shown) on the side of the loudspeaker housing 1 which allows a hand to access the horn 3. Another option is to attach the horn 3 to the tweeter driver 5 by means of a plug connection, so that unplugging the horn 3 (or the diffraction gap 3*a*) allows repositioning through 90°.

The acoustic element 4 may be mounted at a fixed location on the loudspeaker housing 1, provided that the horn 3 (or the diffraction gap 3*a*) can be repositioned relative to the loudspeaker housing 1. Another option is for the acoustic element 4 to be able to be repositioned relative to the loudspeaker housing 1, e.g. by means of a plug connection or a rotary mechanism. In this case, the horn 3 (or the diffraction gap 3*a*) may be arranged at a fixed location relative to the loudspeaker housing 1. It is also possible for the horn 3 (or the diffraction gap 3*a*) and the acoustic element 4 to be able to be repositioned relative to the loudspeaker housing 1. In addition, it is also possible for a plurality of different acoustic elements 4 to be provided, with one acoustic element 4 being provided for the vertical position of the loudspeaker box 300 and the other acoustic element 4 being used when the loudspeaker box 300 is positioned on its side.

Figure 11:
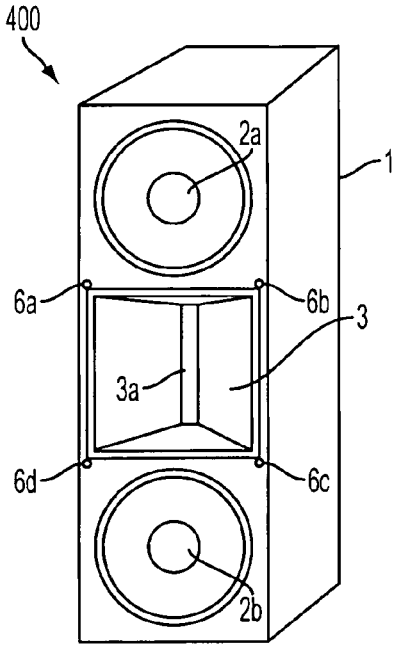
FIG. 11 shows a perspective illustration of a further reconfigurable loudspeaker box with a positioning mechanism for the acoustic element.

FIG. 11 shows another exemplary embodiment, which relates to a loudspeaker box 400 with a loudspeaker housing 1 and a horn 3 (or diffraction gap 3*a*) which can be positioned in different rotational positions relative to the loudspeaker housing 1 using a mechanism. In addition, the loudspeaker box 400 comprises a positioning mechanism, for example in the form of a coupling 6, for an acoustic element which dilates or constricts the radiation of sound from the horn 3 (or from the diffraction gap 3*a*) in at least one radiation plane.

In this exemplary embodiment, as already explained with reference to FIGS. 3 and 4, the horn 3 (or the diffraction gap 3*a*) is repositioned or twisted in order to match the radiation behaviour of the loudspeaker box 400 in the tweeter range to the respective situation of use (loudspeaker group or standalone solution) and position of the loudspeaker box (on its side or upright). However, the acoustic element 4 is required only in one of these two situations of use or positions, which is why the loudspeaker box 400 provides the coupling 6 by means of which the acoustic element 4 is fitted on the loudspeaker box 400 in one of the two situations of use or positions. By way of example, provision may be made for the horn 3 (or the diffraction gap 3*a*) to have a radiation characteristic for which the radiation angle is approximately 100° in the dimension crosswise relative to the diffraction gap and is approximately 20° in the dimension parallel to the diffraction gap. In this case, in the position of the loudspeaker box 400 which is shown in FIG. 3, the desired radiation angle of approximately 100° in the horizontal direction and the desired radiation angle of approximately 20° in the vertical direction, which are suitable for use of the loudspeaker box 400 in a loudspeaker group (e.g. line array), are achieved. The loudspeaker box 400 can therefore be operated in a loudspeaker group without an acoustic element.

When the loudspeaker box 400 is set up in the position shown in FIG. 11, the horn 3 (or the diffraction gap 3*a*) is rotated, as already explained with reference to FIG. 4, so that now a radiation angle of 100° in the vertical direction and of 20° in the horizontal direction is produced. Furthermore, an acoustic element 4 (not shown in FIG. 11) which dilates the radiation of sound in the vertical direction to 40° is attached to the loudspeaker box 400 by means of the coupling 6. The acoustic element 4 may have one of the previously described embodiments and, by way of example, leave the radiation of sound in a horizontal direction (which is less critical than the radiation of sound in the vertical direction) unaffected. Instead of approximately 100°, this could also be approximately 80° or an intermediate angle range for both situations of use (loudspeaker group and standalone solution). It would also be conceivable to attach an acoustic element which is a combination of a focusing element (for the horizontal direction) and a defocusing element (for the vertical direction), and again all the implementation forms described above (acoustic transmission lens, acoustic reflective body) and combinations of these implementation forms may be used. The coupling 6 fitted on the loudspeaker housing 1, for example, may be produced in a wide variety of ways, e.g. as a plug coupling with plug openings 6*a*, 6*b*, 6*c*, 6*d* onto which an acoustic element of this kind can be plugged.

If the acoustic element 4 is required only in one of the two situations of use for the loudspeaker box 400, as illustrated with reference to FIG. 11, it may also be attached to the loudspeaker box 400 (e.g. to the loudspeaker housing 1) by means of a swivel, hinged or sliding mechanism and be swivelled, folded or slid in front of the horn 3 in the one situation of use, for example. In this case, instead of the coupling 6, a swivel, hinged or sliding mechanism (not shown) is provided to which the acoustic element 4 is permanently attached and, as explained, is swivelled, folded or slid in front of the horn 3 (or the diffraction gap 3*a*) when required (e.g. in the configuration suitable for standalone operation).

In this second exemplary embodiment, the coupling, swivel, hinged or sliding mechanisms thus form, by way of example, various options for implementing a positioning mechanism which can be used to put the acoustic element 4 into the sound path of the sound source (e.g. diffraction gap 3*a*, possibly with horn 3) in one situation of use or position of the loudspeaker box 400 and to remove it from the sound path of the sound source in the other situation of use or position of the loudspeaker box 400. Apart from this difference, the statements made in relation to the first exemplary embodiment (loudspeaker box 300), in which the acoustic element 4 is arranged in the sound path of the sound source in both situations of use or positions of the loudspeaker box 300, also apply to the second exemplary embodiment illustrated with reference to FIG. 11.

It goes without saying that it is also possible for the sound source 3*a*, 3 to be designed such that the loudspeaker box 400 can be operated in a position (FIG. 4) suitable for standalone operation without an acoustic element (i.e. the horn 3 has the desired radiation behaviour of approximately 40° in the vertical direction and approximately 80° in the horizontal direction, for example) and the coupling, swivel, hinged or sliding mechanism which is in the loudspeaker box 400 can be used to put an acoustic element into the sound path of the sound source 3, 3*a*, which acoustic element corrects the radiation characteristic of the loudspeaker box 400 in the position shown in FIG. 3 to produce the desired values for use in a loudspeaker group. As already mentioned, with the loudspeaker groups, the radiation angle in the vertical direction should be smaller than 25° (e.g. approximately 20° or possibly even smaller), while the radiation angle in the horizontal direction can either remain unchanged (e.g. at approximately 80°) or is optimally above this and is increased to approximately 100°, for example.

It should be pointed out that the numbers indicated for the radiation angles may differ substantially from the exemplary details according to the intended field of use for the loudspeaker group or for the loudspeaker box 400 which is suitable for standalone operation.

A common feature of all the exemplary embodiments is that a loudspeaker box 300, 400 having a sound source 3*a* with a non-symmetrical radiation behaviour can be reconfigured from a loudspeaker box 300, 400 which is suitable for use in loudspeaker groups to a loudspeaker 300, 400 which is suitable for standalone operation by simple measures (repositioning the sound source and/or repositioning an acoustic element 4 and/or adding an acoustic element 4 and/or swapping two acoustic elements 4).

Figure 12:
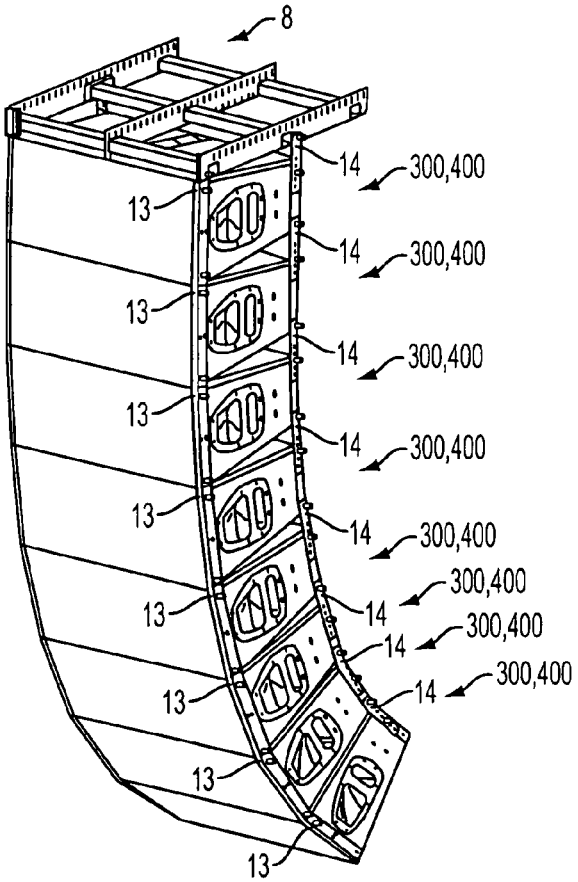
FIG. 12 shows a perspective view of a line array.

FIG. 12 shows a line array comprising a plurality of loudspeaker boxes 300, 400 which are oriented on their side, are linked to one another and are attached to a fly frame 8. The loudspeaker boxes 300, 400 are connected to one another by means of connecting pieces 13, 14, with variable curvature of the line array being able to be set on the basis of the conical housing shape.

The invention claimed is:

1. A loudspeaker box comprising:

a loudspeaker housing;

a sound source with a non-rotationally symmetrical radiation characteristic;

an acoustic element which is arranged in the sound path of the sound source and which dilates the radiation of sound in a first radiation plane and leaves the radiation of sound essentially unchanged in a second radiation plane that is rotated by 90 degrees with respect to the first radiation plane; and a mechanism configured to position the sound source and the acoustic element in different rotational positions relative to one another.

2. A loudspeaker box according to claim 1, wherein the acoustic element comprises one or more perforated panels.

3. A loudspeaker box according to claim 1, wherein the acoustic element comprises a set of parallel lamellae.

4. A loudspeaker box according to claim 1, wherein the acoustic element comprises a porous material.

5. A loudspeaker box according to claim 1, wherein the acoustic element is a transmissive body.

6. A loudspeaker box according to claim 1, wherein the mechanism is in a form such that the sound source can be repositioned in reference to the loudspeaker housing.

7. A loudspeaker box according to claim 1, wherein the mechanism is in a form such that the acoustic element can be repositioned in reference to the loudspeaker housing.

8. A loudspeaker box according to claim 1, wherein the sound source is quasi-linear.

9. A loudspeaker box according to claim 8, wherein the sound source comprises a diffraction gap associated with a loudspeaker.

10. A loudspeaker box according to claim 1, wherein the sound source comprises a ribbon loudspeaker.

11. A loudspeaker box according to claim 8, wherein the sound source comprises an air motion transformer.

12. A loudspeaker box according to claim 8, wherein the sound source comprises a linear arrangement comprising a plurality of loudspeakers.

13. A loudspeaker box according to claim 8, wherein the sound source has a radiation characteristic of no more than 25° in the plane defined by the quasi-linear profile of the sound source.

14. A loudspeaker box according to claim 8, wherein the acoustic element dilates the radiation in a plane defined by the quasi-linear profile of the sound source to at least 30° when positioned such that the first radiation plane coincides with the plane defined by the quasi-linear profile of the sound source.

15. A loudspeaker box according to claim 8, wherein the acoustic element leaves the radiation in a plane defined by the quasi-linear profile of the sound source essentially unchanged when positioned such that the second radiation plane coincides with the plane defined by the quasi-linear profile of the sound source.

16. A loudspeaker box according to claim 8, wherein the quasi-linear sound source has a radiation characteristic of at least 60° in the plane oriented at right angles to the quasi-linear profile of the sound source.

17. A loudspeaker box according to claim 16, wherein the acoustic element leaves the radiation in a plane oriented at right angles to the quasi-linear profile of the sound source essentially unchanged when positioned such that the first radiation plane coincides with the plane defined by the quasi-linear profile of the sound source.

18. A loudspeaker box according to claim 16, wherein the acoustic element dilates the radiation in a plane oriented at right angles to the quasi-linear profile of the sound source to at least 80° when positioned such that the second radiation plane coincides with the plane defined by the quasi-linear profile of the sound source.

19. A loudspeaker box according to claim 1, wherein the loudspeaker housing has a conical cross section.

20. A loudspeaker box comprising:

a loudspeaker housing;

a sound source with a non-rotationally symmetrical radiation characteristic;

a positioning mechanism to position at least one acoustic element, which dilates the radiation of sound in a first radiation plane and leaves the radiation of sound essentially unchanged in a second radiation plane that is rotated by 90 degrees with respect to the first radiation plane, into the sound path of the sound source, the positioning mechanism being configured to position the acoustic element in the sound path of the sound source in one situation of use and to remove the acoustic element from the sound path of the sound source in another situation of use; and a rotating mechanism configured to rotate the sound source in different rotational positions relative to the loudspeaker housing.

21. A loudspeaker box according to claim 20, wherein the positioning mechanism is a coupling.

22. A loudspeaker box according to claim 20, wherein the positioning mechanism is a swivel, hinged or sliding mechanism which can be used to move the acoustic element either into or out of the sound path of the sound source.

23. A loudspeaker box according to claim 20, wherein the sound source has a quasi-linear profile.

24. A loudspeaker box according to claim 21, wherein the sound source has a radiation characteristic of no more than 25° in the plane defined by the quasi-linear profile of the sound source.

25. A loudspeaker box according to claim 24, wherein as soon as the acoustic element is in the sound path of the quasi-linear sound source , the acoustic element dilates the radiation characteristic in the plane defined by the quasi-linear profile of the sound source to at least 30°.

26. A system comprising a plurality of loudspeaker boxes according to claim 1.

27. A system according to claim 26, wherein the arrangement is a line array.

28. A loudspeaker box according to claim 20, wherein, by operating both the positioning mechanism and the rotating mechanism, the angular radiation characteristic relative to the loudspeaker housing is changed between a characteristic adapted for an upright use of the loudspeaker housing and a characteristic adapted for a use on a side of the loudspeaker housing.

* * * * *